US009123315B1

(12) United States Patent
Bachand

(10) Patent No.: US 9,123,315 B1
(45) Date of Patent: Sep. 1, 2015

(54) SYSTEMS AND METHODS FOR TRANSCODING MUSIC NOTATION

(71) Applicant: William R Bachand, Scottsdale, AZ (US)

(72) Inventor: William R Bachand, Scottsdale, AZ (US)

( * ) Notice: Subject to any disclaimer, the term of this patent is extended or adjusted under 35 U.S.C. 154(b) by 0 days.

(21) Appl. No.: 14/320,572

(22) Filed: Jun. 30, 2014

(51) Int. Cl.
*G10G 3/00* (2006.01)
*G10G 1/00* (2006.01)
*G10G 1/04* (2006.01)

(52) U.S. Cl.
CPC .. *G10G 1/04* (2013.01); *G10G 1/00* (2013.01); *G10G 3/00* (2013.01); *G10H 2210/086* (2013.01); *G10H 2220/015* (2013.01); *G10H 2220/121* (2013.01); *G10H 2220/236* (2013.01); *G10H 2220/241* (2013.01); *G10H 2220/451* (2013.01)

(58) Field of Classification Search
IPC ..... G10G 3/00,1/00, 1/04; G10H 2220/015, G10H 2220/121, 2220/451, 2220/236, 2220/241, G10H 2210/086
See application file for complete search history.

(56) References Cited

U.S. PATENT DOCUMENTS 1,539,308 A * 5/1925 Faunt ..... 84/483.2
5,574,242 A * 11/1996 Bui ..... 84/483.1
5,962,800 A * 10/1999 Johnson et al. ..... 84/483.2
5,998,721 A * 12/1999 Lepinski ..... 84/483.2
6,476,303 B1 * 11/2002 Mutou et al. ..... 84/483.2
7,212,213 B2 * 5/2007 Steinberg et al. ..... 345/589
7,241,945 B1 7/2007 Egan
7,439,438 B2 * 10/2008 Hao ..... 84/483.2
7,750,224 B1 * 7/2010 Rav-Niv et al. ..... 84/483.1
8,039,722 B2 * 10/2011 MacCoy ..... 84/483.2
8,044,288 B1 10/2011 Prieto
8,835,737 B2 * 9/2014 King ..... 84/483.2
2004/0007118 A1 * 1/2004 Holcombe ..... 84/483.2
2004/0139843 A1 * 7/2004 Forster ..... 84/483.2
2008/0072738 A1 * 3/2008 Plamondon et al. ..... 84/423 R
2008/0141849 A1 * 6/2008 Johnston ..... 84/483.2
2009/0064847 A1 * 3/2009 Hao ..... 84/483.2
2009/0266222 A1 * 10/2009 Epstein ..... 84/483.2
2012/0216666 A1 * 8/2012 Fresolone ..... 84/483.2
2014/0041512 A1 * 2/2014 Mastran et al. ..... 84/483.2

OTHER PUBLICATIONS http://musicnotation.org/system/notograph-by-constance-virtue/ accessed Aug. 27, 2014 4 pages.

* cited by examiner

*Primary Examiner* — David Warren
(74) *Attorney, Agent, or Firm* — William R Bachand

(57) ABSTRACT

A method for transcoding music, according to various aspects of the present invention, includes in any practical order: (a) reading indicia of a plurality of notes, each note having pitch and duration; (b) selecting a reference pitch; (c) determining indicia of tone from the reference pitch and the pitch of each note; and (d) outputting for use by an engraving engine, indicia of an apposite staff and indicia of tones and durations corresponding to the plurality of notes.

6 Claims, 4 Drawing Sheets

SYSTEMS AND METHODS FOR TRANSCODING MUSIC NOTATION

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
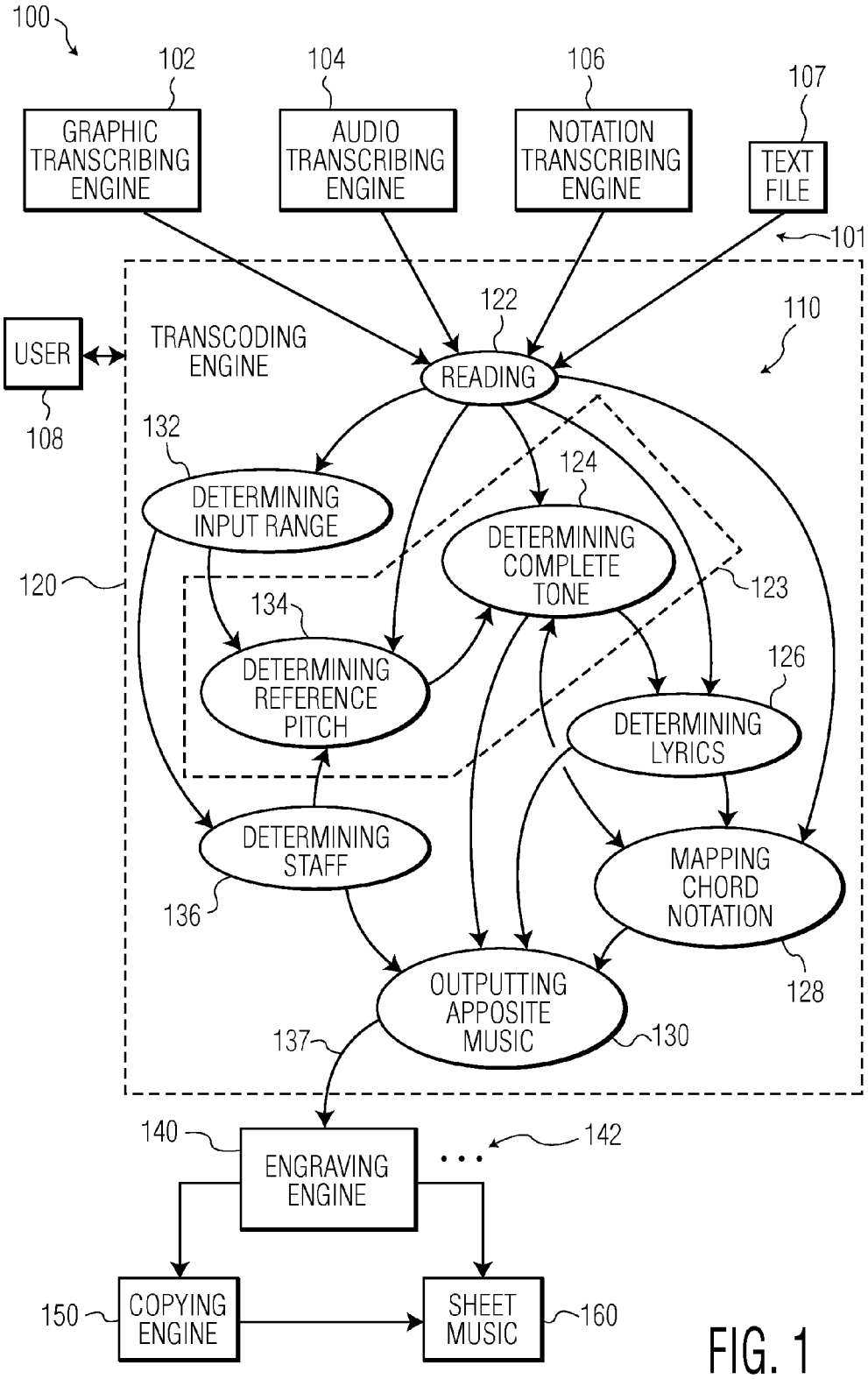
FIG. 1 is a data flow diagram of a system and method for transcoding music notation according to various aspects of the present invention.

A method for transcoding transposable music notation to produce apposite music notation, according to various aspects of the present invention, facilitates engraving apposite music notation to be more easily accepted for automated music analysis, and more easily understood by humans. Transcoding, according to various aspects of the present invention, is a process (i.e., method, step of a method) that accepts transposable music notation as input in any conventional format representing, for example a sequence of notes and rests, and produces information sufficient for an engraving engine to produce a visual presentation of corresponding music in apposite music notation. After transcoding, for example, all notes in transposable music notation representing complete pitches are represented in the apposite music notation as complete tones.

According to one aspect of the present invention, engraving of tones transcoded from a major scale (or any other sequence of complete pitches) in a particular key is controlled to be engraved from apposite music notation that is independent of the key. For example, a major scale in the key of D (a key signature of two sharps) may be transposed to the key of B flat (a key signature of three flats) using conventional transposing technique and after engraving transposable music notations would produce quite different visual presentations on the traditional 5-line staff with key signature. In contrast, the major scale in the key of D and the major scale in the key of B flat would each be transcoded into identical apposite music notation that when engraved would produce identical visual presentations (i.e., the presentation is independent of the key).

Apposite music notation reveals the scalar position of each note in any sequence of notes (e.g., the fifth position or seventh position of the major scale). Apposite music notation reveals the quantity of half-steps between successive notes in any sequence of notes.

Engraving, as used herein, uses conventional technologies to produce a visual presentation suitable for reproduction on more-permanent media (e.g., paper, disks, tape, optical storage, magnetic storage, removable media, removable semiconductor memory) and less-permanent media (e.g., displays, screens, installed semiconductor memory). Engraved media of any form is referred to herein as sheet music.

Music comprises rests and notes, more particularly a sequence in time of rests and notes. The notes are described using a music notation. One or more notes may concurrently sound (e.g., as produced by a monophonic or polyphonic instrument) and be represented in a notation that represents monophony and polyphony. Apposite music notation represents monophony and/or polyphony for one or more voices (e.g., vocal, instrumental).

Automated analysis of transposable music notation or apposite music notation may include forming an image (e.g., data from a digital camera or scanner) from sheet music media and analyzing the image. Machines and humans may read sheet music representations of transposable music notation and apposite music notation by recognizing time represented from earlier to later in a horizontal dimension (e.g., left to right). Reading transposable music notation includes recognizing complete pitches (e.g., audible frequency of sound) represented from lower to higher in a vertical dimension. Reading apposite music notation includes recognizing complete tones represented from lower to higher in a vertical dimension without determining or recognizing a particular complete pitch.

Transposable music notation as used herein refers to a class of notations for music where a sequence of notes is described as a sequence of complete pitches characterized by a key. A first sequence of notes may be transposed to a different key to produce a second sequence of compete pitches characterized by the second key. Techniques for such transposition are well known.

A note in a transposable notation indicates a complete pitch when only one frequency is intended by the notation. A graphic transposable notation may use a dot (open or closed) for each note, placing the dot with a vertical beam on a staff having lines and spaces. For example, in the most common western traditional music notation (involving the 5-line staff, the treble or G clef, the bass or F clef, and key signature, herein called traditional notation), a transposable notation, 'middle C' is represented by a graphic notation between two 5 line staffs. A sequence of notes written on a staff in this notation is understood to convey complete pitches characterized by a key signature, a dot having a position on a staff, and symbols called accidentals that are placed near the dot.

A transposable music notation may include indicia of a complete pitch (with octave) and other indicia of an incomplete pitch (without octave). For example, in traditional notation, the 12 members of a transposable chromatic scale of 12 half-steps in pitch are referred to with letters A through G with accidentals (e.g., sharps, flats, naturals) to indicate a half step between the letters. The notation F (or F7) conveys an incomplete pitch (or a chord) without identifying an octave. A notation of pitch that is ambiguous as to octave is herein called an incomplete pitch. A notation describing a sequence of incomplete pitches is insufficient for engraving traditional sheet music without specifying an octave.

A note represented in a transposable music notation has pitch and duration. Complete pitch and incomplete pitch are used herein to refer to notes represented in a transposable music notation.

An apposite music notation refers to a class of notations for music where each note is described as a complete tone. Music notation is apposite when notes are represented without (e.g., agnostic to) conveying pitch. A passage of music may be performed (vocal and/or instrumental) by reading apposite music notation and applying one complete pitch as a reference pitch.

A complete tone is suitable for engraving onto a staff for apposite music notation. The notation of a complete tone is sufficient for such engraving because there is no ambiguity as to a staff position for the engraving. A graphic apposite music notation may use a dot (open or closed) for each note, placing the dot with a vertical beam on a staff having lines and spaces. For example, a 7-line staff without clef or key signature may be used for representing an apposite music notation where the range of the tones is within a practical range of the staff (e.g., less than two octaves for the 7-line staff). A sequence of notes written on a staff in this notation is understood to convey complete tones. This notation is not transposable because apposite music notation does not specify a sequence of complete pitches nor is the sequence characterized by a key.

An apposite music notation may include indicia of a complete tone (with octave) and other indicia of an incomplete tone (without octave). For example, a complete tone includes indicia of position in a 12-tone apposite chromatic scale and indicia of an octave. An incomplete tone does not include indicia of octave. As discussed herein, a 12-tone apposite chromatic scale may be described by a group of symbols, for example, alphabetic letters I through T. Apposite music notation does not employ accidentals. The notation P (or P7) conveys a tone (or a chord) without identifying an octave. A notation of tone that is ambiguous as to octave is herein called an incomplete tone.

An apposite music notation describing a sequence of incomplete tones may be sufficient for engraving onto a staff when there is no ambiguity as to octave. For example, a sequence having a range of only one octave may be engraved on a staff that suitably supports only one octave.

An apposite music notation describing a sequence of complete tones is sufficient for engraving without ambiguity. The sequence may have a range of one or more octaves. The staff may suitably support one or more octaves.

A note represented in an apposite music notation has tone and duration. Complete tone and incomplete tone are used herein to refer to notes represented in an apposite music notation.

Any two notes of transposable music notation are separated by a difference in pitch described as an integer quantity of half-steps (based on twelve half steps in any octave). After transcoding, the tones of the apposite music notation are separated by the same difference measured in half-steps. Transposable music notation may be determined from apposite music notation by assigning a complete pitch to one tone. Any complete pitch may be used. Transcoding apposite music notation from transposable music notation includes determining one complete pitch, herein called the reference pitch.

The complete pitch used as a reference pitch may be derived from two characteristics of a transposable music notation for a sequence of notes. In a preferred implementation, the reference pitch is derived from the key. The key constitutes an incomplete pitch. The key may be derived from the key signature. In a preferred implementation, the reference pitch is also derived from the range of the sequence of notes. The reference pitch is then mapped to the first tone of a 12-tone apposite chromatic scale in an octave between the practical extremes of the staff to be used for engraving the apposite music notation.

To avoid a prolix specification, transposable music, as discussed below, means any transposable music notation. Apposite music, as discussed below, means any apposite music notation.

In an exemplary implementation, transcoding is accomplished as a method involving reading, mapping, and outputting information for an engraving engine. Reading includes translating input information into symbols of transposable music. Mapping includes establishing a notation of a twelve-pitch transposable chromatic scale in one to one relationship to notation of a twelve-tone apposite chromatic scale and analogs in other octaves. The twelve-tone scale may be assigned to start on any one of the twelve pitches of the twelve-pitch scale to form a map. The map may be implemented as data (e.g., a cross reference, an index, a look up table) or instructions. The data may be interpreted or used by data processing software performed by a processor (e.g., spreadsheet, database manager, interpreter). Instructions (e.g., logical expressions, mathematical expressions, and constructs in a conventional computer programming language for execution, compilation, and/or interpretation) may be performed by a processor (e.g., directly without interpretation, interpreted by interpreting software being performed by the processor). Outputting includes determining data and/or instructions in a form suitable for a particular engraving engine or class of engraving engines (e.g., transcoding output may be configured to conform to an industry standard input format for engraving engines). Any conventional processor circuitry and software technologies may be used to accomplish reading, mapping, and outputting in light of this specification.

A transcoding engine, performs transcoding as discussed above. A transcoding engine, according to various aspects of the present invention is implemented as a combination of conventional processor circuitry and firmware and/or software recalled from conventional memory (e.g., semiconductor, magnetic) of the processor circuitry and performed by a processor of the processor circuitry. The processor circuitry may be part of a conventional computer system (e.g., personal computer, cellular phone, personal assistant, server, plurality of cooperating servers). The firmware or software may be developed, in light of this specification, using conventional software development technologies.

For example, system 100 of FIG. 1 includes one or more transcribing engines 102, 104, and 106 that supply transposable music 101, and may cooperate with a user 108 who may specify, inter alia, process control information. System 100 provides apposite music 137 to one or more of a plurality of engraving engines 142. Engraving engine 140 of the plurality 142 may output apposite music as sheet music 160 on suitable media as discussed above or direct a copying engine 150 to output apposite music as sheet music 160.

System 100 includes a transcoding engine 120 that receives transposable music 101 from one or more sources including graphic transcribing engine 102, audio transcribing engine 104, notation transcribing engine 106, and/or text file 107. Transcoding engine 120 performs a method for transcoding 110. The lines in FIG. 1 correspond to information that may be communicated between engines or communicated between processes in any conventional manner (e.g., shared memory, multiple access data storage, point to point links, networks). When memory or storage facilitate the communication, any conventional data representation technologies may be used, transfers may be batched or streamed, and conventional communication protocols may be used. When links or networks facilitate the communication, any conventional message structures may be used, transfers may be batched or streamed, and conventional communication protocols may be used. Any line in FIG. 1 may include storage (not shown). Conventional data storage technologies may be used. One or more processes of transcoding engine 120 performs its (their) function(s) asynchronously, as directed by user 108, as resources become available, and/or as inputs from communication or storage become available. Storage on different lines may be combined in any practical manner (e.g., relational database, file system, data structures in memory).

Information indicated as input to a process is read (e.g., accepted, obtained, or received) by the process. Information indicated as output from a process is written (e.g., provided, transmitted, or access to the information granted) by the process. When information is written to an output device (e.g., display, printer, removable storage system, SIM-card writer, CD burner, DVD burner) the resulting media may be read by a machine or human not part of system 100. For communication between processing circuits, conventional network port technology (e.g., transceivers for wired, optical, or radio communication) may serve as an input peripheral to be read or an output peripheral to be written.

The lines with arrows indicate the flow of primary information. In addition, engines and/or processes may cooperate with communication (e.g., via the same line) for controlling the flow of primary information using conventional technologies (e.g., notify, request, acknowledge receipt, subscribe to agreed availability and/or data).

Data flow on any line may also include packetized workflow identification so that multiple packets may be identified in sequence for one sheet music product. Consequently, a plurality of threaded workflows may be processed independently in time (e.g., substantially parallel processing).

Data flow on any line may also include hierarchical workflow information so that hierarchical sheet music product may be directed to be produced. For example one hierarchy may define a book of music arrangements, each arrangement for a set of voices (e.g., vocal parts or instruments), each voice being a sheet music product on uniquely identifiable media or portion of hierarchal media (e.g., data structures, files, collections of files, database records).

A graphic transcribing engine 102 reads transposable music from sheet music where the transposable music is represented in graphic symbols (e.g., staffs, clefs, dots, stems, flags, time signatures, key signatures, sharps, flats, naturals, alphanumeric notation for chords). The graphic transcribing engine 120 writes transposable music in a conventional notation involving characters and numbers more easily recognized by a processor (e.g., musicXML marketed by MakeMusic, Inc., Lilytext (e.g., version 12.18.2, defined in "LilyPond Notation Reference" and available at www.lilypond.org, incorporated herein by this reference)).

An audio transcribing engine 104 reads transposable music from sound and/or representations of sound (e.g., microphones, pickups, analog recordings, digital recordings, computer readable sound files). The audio transcribing engine writes transposable music in a conventional notation (e.g., musicXML, MIDI managed by MIDI Manufacturers Association, Lilytext).

A notation transcribing engine 106 reads transposable music from computer readable sources to output transposable music in a different format. For example, notation transcribing engine 106 reads transposable music in the format that would be presented to a conventional engraving engine (e.g., Lilytext) and writes transposable music in musicXML. For another example, MIDI files are transcribed by notation transcribing engine 106 to write transposable music in musicXML.

Transposable music in computer readable form may be input to transcoding engine 120 without the need for notation transcribing. For example, text file 107 comprising Lilytext may be input to transcoding engine 120.

In a first implementation according to various aspects of the present invention, method for transcoding 110 includes reading process 122, mapping process 123, and outputting apposite music process 130 that provides apposite music 137 for engraving. In this configuration, input transposable music indicates a key used for a reference pitch, and input transposable music is acceptable when it falls within a predetermined range of pitches that are suitable for representation unambiguously on a predetermined staff.

In a second implementation according to various aspects of the present invention, method for transcoding 110 includes reading process 122, mapping process 123 comprising determining complete tone process 124 and selecting pitch process 134, determining input range process 132, determining staff process 136, and outputting apposite music process 130 that provides apposite music 137 for engraving. This implementation provides greater utility of the transcoding engine, for example, transcoding a wider variety of voices, and transcoding hierarchical sheet music using staffs appropriate to a range of each voice.

In a third implementation according to various aspects of the present invention, method for transcoding 110 includes all of the process of the second implementation and further includes determining lyrics process 126 and/or mapping chord notation process 128.

Apposite music 137 written by method 110 in any of the above implementations is output from transcoding engine 120 for engraving. Engraving may be accomplished by one or a plurality of engraving engines 142 (e.g., each configured for a particular type of media, delivery mechanism, and/or processing efficiencies) For example, engraving engine 140 of plurality 142 writes to a copying engine 150 and/or writes sheet music 160.

A reading process includes any process performed by a transcoding engine to accept indicia of transposable music and create an internal representation of a sequence of rests each having duration and notes each having pitch and duration. Transposable music in one format or in a wide variety of formats may be read by one reading process. The reading process simplifies further transactions and analysis of the transcoding engine processes. Each other process that refers to indicia of transposable music for its own purposes can efficiently refer to the internal representation, regardless of the complexity of reading from transcribing engines external to the transcoding engine. Consequently, reading by these other processes is more reliable.

Method 110 and the reading process may read and represent polyphonics, chords, dynamics, articulations, lyrics, and music for engraving simultaneous voices (e.g., several singing voices, several instruments, several polyphonic instruments) for each thread, as discussed above. For clarity, simplified transposable music for one voice capable of one note at a time will be discussed below. The techniques discussed below may be performed in sequence, concurrently, and/or simultaneously until all voices of a thread are processed.

For example, reading process 122 reads the outputs of any one or more of graphic transcribing engine 102, audio transcribing engine 104, and notation transcribing engine 106. Various transcribing engines may provide inputs describing unique respective sheet music products. Various transcribing engines may provide inputs that describe transposable music to be combined into one sheet music product. Reading process 122 may also read information from a conventional network, processor, or data store (e.g., text file 107) where the information is formatted for an engraving engine 140 (e.g., Lilytext or MusicXML not requiring transcription by notation transcribing engine 106). In one implementation, reading process 122 reads only one format (e.g., musicXML). In other implementations the number of different readable formats may be expanded by installing modules (e.g., libraries, snap-ins, plug-ins, drivers) in reading process 122 that are developed using convention technologies.

Reading process 122 writes a representation of the transposable music in an internal representation for determining input range process 132, mapping process 123, determining reference pitch process 134, determining complete tone process 124, determining lyrics process 126, and mapping chord notation process 128. Writing may be in respective formats unique to one or more of these processes and/or in one form (e.g., a relational database queried uniquely by each process).

A determining complete tone process includes any process performed by a transcoding engine that writes indicia of complete tone for each input indicia of complete pitch. The tone is determined in accordance with a reference pitch that is input to the determining complete tone process. Tone may be determined arithmetically (e.g., pitches and tones are represented by whole numbers in base 12) or by table lookup (e.g., pitches and tones are represented by ordered members of sets such as alphabetic symbols). The internal representation used for communication between processes of method 110 may support transposable music and apposite music. In another implementation, representation of transposable music uses a first internal representation and representation of apposite music uses a second different internal representation.

For example, determining complete tone process 124 reads conventional transposable pitches as indicia in the internal representation corresponding to the rows of Table 1. An incomplete pitch is determined from the reference pitch. For the incomplete pitch shown as a column heading, determining complete tone process 124 determines indicia of incomplete tone shown at the intersection of the row and column. In this example, the letters I through T correspond (in an increasing half-step order) to 12 apposite tones. A complete tone is then determined for the incomplete tone in accordance with the transposable pitch and the reference pitch. For example, the octave of the transposable pitch may be copied as the octave of the complete tone.

TABLE 1

| | | Reference Pitch (incomplete) | | | | | | | | | | | |
|---|---|---|---|---|---|---|---|---|---|---|---|---|---|
| | | A | A# | B | C | C# | D | D# | E | F | F# | G | G# |
| Input | G# | T | S | R | Q | P | O | N | M | L | K | J | I |
| Pitch | G | S | R | Q | P | O | N | M | L | K | J | I | T |
| (incomplete) | F# | R | Q | P | O | N | M | L | K | J | I | T | S |
| | F | Q | P | O | N | M | L | K | J | I | T | S | R |
| | E | P | O | N | M | L | K | J | I | T | S | R | Q |
| | D# | O | N | M | L | K | J | I | T | S | R | Q | P |
| | D | N | M | L | K | J | I | T | S | R | Q | P | O |
| | C# | M | L | K | J | I | T | S | R | Q | P | O | N |
| | C | L | K | J | I | T | S | R | Q | P | O | N | M |
| | B | K | J | I | T | S | R | Q | P | O | N | M | L |
| | A# | J | I | T | S | R | Q | P | O | N | M | L | K |
| | A | I | T | S | R | Q | P | O | N | M | L | K | J |

Determining complete tone process 124 writes indicia of complete tone to determining lyrics process 126 and to outputting apposite music process 130.

An outputting process includes any process performed by a transcoding engine to provide apposite music to an engraving engine in a format dictated by the engraving engine. Information for engraving apposite music includes information that determines the sequence of rests having duration and notes having apposite tone and duration. In addition, information that determines one or more staves for the apposite music may be included, for example, when the engraving engine is not already configured to process apposite music on one or more preconfigured staves.

For example, outputting process 130 reads information in the internal representation (or second internal representation) that determines a sequence of rests having duration and notes having tone and duration. Outputting process 130 reads information from determining staff process 136. Outputting process 130 writes information sufficient for an engraving engine to engrave one or more staves and also writes information sufficient for an engraving engine to engrave all of the rests and notes of the apposite music. Outputting process 130 reformats the internal representation read from determining staff process 136, determining complete tone process 124, determining lyrics process 126, and mapping chord notation process 128, to write in one or more respective formats accepted by engraving engines of plurality 142. Outputting process 130 controls (e.g., drives) engraving by writing information sufficient for engraving. Control may be via batch or streaming communication.

A determining input range process includes any process performed by a transcoding engine to provide indicia of a maximum pitch and a minimum pitch. An input range may be specified by user 108. An input range may be responsive to indicia of a type of voice (e.g., name of an instrument or vocal range (e.g., alto)) whose range is known. An input range process may review transposable music (entirety or portion) for determining a range of complete pitches that would include the complete pitch of every note in the transposable music (entirety or portion). Determining a range may include finding the highest complete pitch and the lowest complete pitch. The determined range of pitch may be associated with a sequence of transposable music (e.g., for all packets of a workflow, for a series of packets, or for each packet) and written for determining a reference pitch. The determined range of pitch may also be converted to a range of tones and written for determining a staff. Exceptions to the determined range and new range determinations may be written as needed. The reference pitch may be adjusted higher or lower within the same workflow, generally with adjustments of one octave or a multiple of an octave.

For example, determining input range process 132 reads transposable music from reading process 122 comprising a sequence of rests and notes of a suitable extent (e.g., music intended for one voice of one entire sheet music product). Each next note is compared to the previous note. If the next note is higher in complete pitch as indicated by the internal representation, the proposed highest pitch is given the value of the complete pitch of the next note. If the next note is lower in complete pitch as indicated by the internal representation, the proposed lowest pitch is given the value of the complete pitch of the next note. When the end of the sequence is read, the range may be written as the highest and lowest pitches, and/or as a reference pitch and a difference of pitches measured in half-steps (e.g., low to high, middle and +/− peak). Determining input range process 132 writes the determined range to determining reference pitch process 134 and to determining staff process 136.

A determining reference pitch process includes any process performed by a transcoding engine to specify a pitch from which apposite notation is determined. If the determined input range changes significantly (e.g., by an octave or multiple of octaves), then the reference pitch may also be adjusted (e.g., by an octave or multiple of octaves) to assure that the tone is within a range of tones supported by the determined staff or staves. A determining reference pitch process writes indicia of the reference pitch to a determining complete tone process. The reference pitch may be specified by user 108, derived from indicia of a key signature of the internal representation, or derived using conventional technologies from the range and an analysis of the style of the music (e.g., determining a suitable key of the music from the music itself). As an example of determining the key from the music itself, for most western music, the reference pitch is the pitch of the root of a major or minor scale and generally minimally dissonant with a conventional chord pattern for accompaniment (or a chord pattern read from the internal representation). In addition, the reference pitch is preferably selected to be central to a two octave range that includes most of the notes of the sequence.

For example, determining reference pitch process 134 reads indicia of key signature if any from reading process 122, reads indicia of key from user 108 if available, and/or reads indicia of transposable music from reading process 122 to determine a suitable key from the music itself as discussed above. The reference pitch is then completed with reference to the range read from determining input range process 132. Adjustment with reference to the input range and with reference to indicia of a staff read from determining staff process 136 assures that most of the apposite music will be within the range represented on the staff (e.g., minimal engraving of notes above and/or below the staff). Determining reference pitch process 134 writes indicia of the reference pitch to determining complete tone process 124 and mapping chord notation process 128.

A determining staff process includes any process performed by a transcoding engine to indicate to an outputting process a suitable staff for engraving notes of apposite music. A particular sheet music product may use one or more staves. Engraving notes above or below the staff (which are somewhat more difficult to read by machine or human) may be avoided by determining a staff having a sufficient range (e.g., one or more octaves).

For example, determining staff process 136 reads an input range from determining input range process 132, and writes indicia of a staff to determining reference pitch process 134 and to outputting apposite music process 130. A two octave staff is preferred with the tone corresponding to the reference pitch to be engraved on a central line of the two octave staff.

In an implementation using base 12 arithmetic, transcoding an input pitch to produce an output tone uses the equations described in Table 2.

TABLE 2

| Expression | Description | Example |
|---|---|---|
| FR = HP − LP | Full range (FR) is the difference between the highest complete pitch (HP) and the lowest complete pitch (LP) of the sequence of music to be transcoded. Full range, highest pitch, and lowest pitch are positive whole numbers of half-steps; where every octave consists of 12 half-steps. FR, HP, and LP are represented in base 12. | Consider the sequence (in the key of D): D, E, F♯, D where all notes are just over one octave above middle C. The pitch A (440 Hz) may be represented as $50_{12}$ as in the fifth octave from the lowest human audible pitch. The sequence in base twelve is 65, 67, 69, 65. HP is 69. LP is 65. FR is 4. |
| CP = INT(FR/2) + LP | Center pitch (CP) of the full range is calculated as the whole number part of the full range divided by two, plus the lowest complete pitch. | CP is 2 + 65 or 67. |
| RO = INT(CP/$10_{12}$) | Reference octave (RO) is calculated as the whole number part of the center pitch divided by 12 (which is represented as 10 in base 12). RO is a whole positive number in base 12. | RO is 6. |
| RP = (RO * $10_{12}$) + MK | Reference pitch (RO) is the sum of reference octave and music key (MK). Music key is the incomplete pitch that the sequence of notes is characterized by. Music Key is a whole positive quantity of half-steps that is less than 12 and represented in base twelve. For the traditional chromatic scale from A to G♯ corresponding to 0 to 11 half-steps, the key of D would be represented by the number 5. There are 5 half-steps from A to D in the traditional chromatic scale. | MK is 5. RP is 60 + 5 or 65. |
| OT = IP − RP | Output tone (OT) is calculated as the difference between the input complete pitch (IP) and the reference pitch, a complete pitch. OT and IP are whole numbers of half-steps represented in base 12. Output tone may be positive when the input pitch is higher than the reference pitch, zero when the input pitch is the same as the reference pitch, and negative when the reference pitch is higher than the input pitch. | OT for each IP (65, 67, 69, 65) is (0, 2, 4, 0) and may be represented by the symbols (I, K, M, I) selected from the group of 12 symbols I through T of the alphabet in alphabetical order. |

A determining lyrics process includes any process performed by a transcoding engine to identify a style of the apposite music. A determining lyrics process may read indicia of rhythm and/or indicia of tone and produce a sequence of pronounceable symbols, syllables, or words to be engraved in juxtaposition to the sequence of rests and notes of apposite music. Pronounceable symbols may include alphabetic letters (e.g., I through T). Pronounceable syllables and/or words may aid in the proper performance (e.g., execution in time) of the apposite music on an instrument (e.g., tonguing a wind instrument, bowing, strumming, or plucking a string instrument). A word as used herein includes any combination of syllables without regard to accepted meaning, if any. A syllable as used herein includes any morpheme and may include one or more vowels, uttered in sequence.

For example, determining lyrics process 126 reads indicia of rhythm from reading process 122 and/or reads indicia of tone from determining complete tone process 124 to provide information for writing to outputting apposite music process 130 one or more sequences of pronounceable symbols, syllables, and hyphenated words that elucidate an aspect of the apposite music, such as a rhythm and/or a riff that may be characteristic of a style of music (e.g., simplifying machine or human recognition of the style).

A mapping chord notation process includes any process performed by a transcoding engine to present a suggested accompaniment for a voice (e.g., melody) of apposite music. The suggested accompaniment may indicate a style of the apposite music. A chord is a polyphonic subset of a scale. Conventional transposable chord notation is incomplete (i.e., not prescribing an octave), identifies a root pitch, and identifies a chord type. Conventional chord types are named (e.g., major, dominant seventh, minor, minor seventh, sustained, diminished, augmented, major seventh, seven flat five, etc.). Transposable chord notation is identifiable to a conventional chord name by conventional symbols (e.g., B° means B diminished). Generally, all incomplete pitches of the chord are not identified in transposable chord notation because to do so would make the notation too difficult to recognize by humans.

An apposite chord, may be determined with reference to an incomplete reference pitch. An apposite chord may indicate a combination of incomplete tones corresponding to the transposable chord root pitch and type.

For example, mapping chord notation process 128 reads indicia of a sequence of transposable chords (identifying incomplete pitches) from reading process 122 and indicia of reference pitch from determining reference pitch process 134. For each transposable chord, mapping chord notation process 128 determines the incomplete pitches of the transposable chord from definitions of transposable chord members that constitute the transposable chord as indicated by the transposable chord notation. Mapping chord notation process 128 may use a table look up operation based on an internal representation of Table 1 to transcode each incomplete pitch into an incomplete tone. For example, traditional chord Am7 indicates a minor seventh chord with pitches A (the root), C, E, and G). Transcoding of an Am7 chord with E as the reference incomplete pitch (using letters I-T as for a 12-tone chromatic scale) would produce N, Q, I, and L as member tones (see Table 1). A representation of the chord in apposite music may include all of the incomplete tones (e.g., the root tone as a capital letter and the additional tones as a subscript, the root tone followed by one or more member tones listed in increasing pitch order of the chord's incomplete pitches).

An engraving engine reads a computer readable representation of music to write corresponding sheet music 140 to be read by a machine for analysis and/or performance, and/or read by humans for analysis and/or performance. Any conventional engraving engine may be part of system 100.

For example, engraving engine 140 includes software marketed by the open source project www.lilypond.org performed by a conventional personal computer to engrave transposable music. Lilypond software includes drivers for printing sheet music on paper and outputting a file (e.g., Acrobat .pdf format marketed by Adobe Inc.) for a copying engine 150 to prepare copies of sheet music. Lilypond software in a configuration according to various aspects of the present invention, engraves apposite music on a two-octave staff. The sheet music product as printed on paper may be scanned for analysis by a personal computer and read by software for music analysis. The sheet music product as printed paper may be read by humans as well. The input language required by Lilypond is herein called Lilytext. Lilypond is also capable of outputting music in MIDI format.

Copying engine 150 may be implemented with a personal computer and appropriate peripherals and drivers for writing desired media for sheet music.

Figure 2:
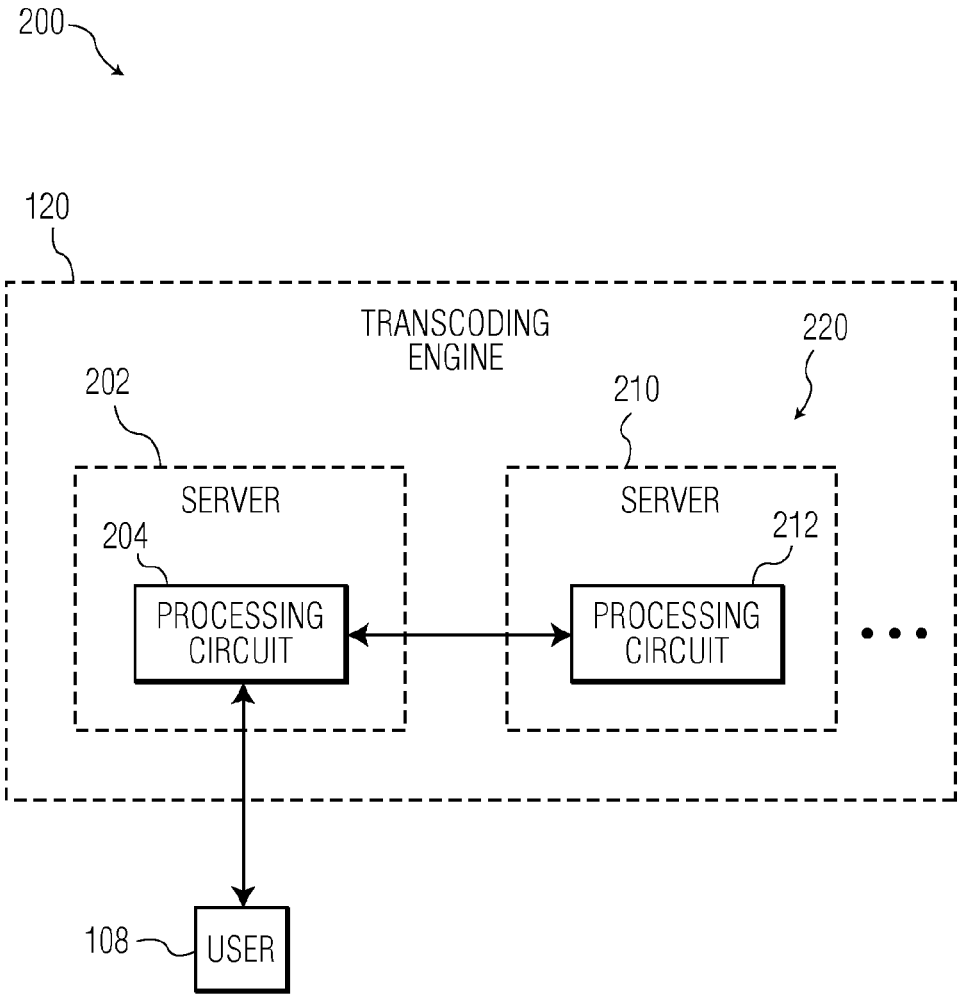
FIG. 2 is a functional block diagram of the transcoding engine of FIG. 1.

System 100 and in particular transcoding engine 120 may be implemented on one or more servers coupled for conventional communication (e.g., TCPIP over the internet). For example, in system for transcoding 200 of FIG. 2 transcoding engine 120 includes server 202 and outputs information to an engraving engine performed by one or more of the plurality of servers 220. Each server provides general purpose processing and communicating capabilities implemented with conventional server technologies in hardware and software. Server 202 includes processing circuit 204 comprising a processor, peripherals (e.g., memory, data storage subsystems, control console, printers, network ports), and software for some or all of the processes of method 110 discussed above. Software for the operating system of the server and for its peripherals and ports may be of conventional design (e.g., supporting threaded workflows, virtual machines).

When method 110 is implemented as a distributed process, one or more servers of plurality 220 may perform one or more of the processes of method 110. For example, processor circuit 204 may perform reading process 122, determining reference pitch process 134, and outputting apposite music process 130; and all other processes may be performed by processor circuit 212. In this configuration, user 208 controls reading process 122 by specifying what to read; controls determining reference pitch process 134 to confirm or specify a reference pitch; and controls outputting apposite music process 130, for example, by specifying suitable media for sheet music 160. Sheet music 160 may be provided to user 108 (e.g., via server 202 from an engraving engine performed by server 210, an engraving engine performed by server 202, or an engraving engine performed on a personal computer (not shown) used by user 108 to communicate with transcoding engine 120).

Information for the preparation of sheet music includes specifications for symbols that appear on the sheet music. For example, sheet music 300 of FIG. 3, written according to various aspects of the present invention, includes staves 301 and 302 (being a continuation of staff 301), a time signature 304 (in conventional format), bars 305 and 306 delineating (as an example) one measure, lyrics 308 presented under each staff 301 and 302, a sequence of apposite chords 309 presented above each staff 301 and 302, and a sequence of apposite music 320 comprising rest symbols and note symbols of conventional appearance and meaning. For example, open dot 362 and beam 364 represent one complete tone (e.g., I) as one note positioned on the central line of staff 302.

Figure 3:
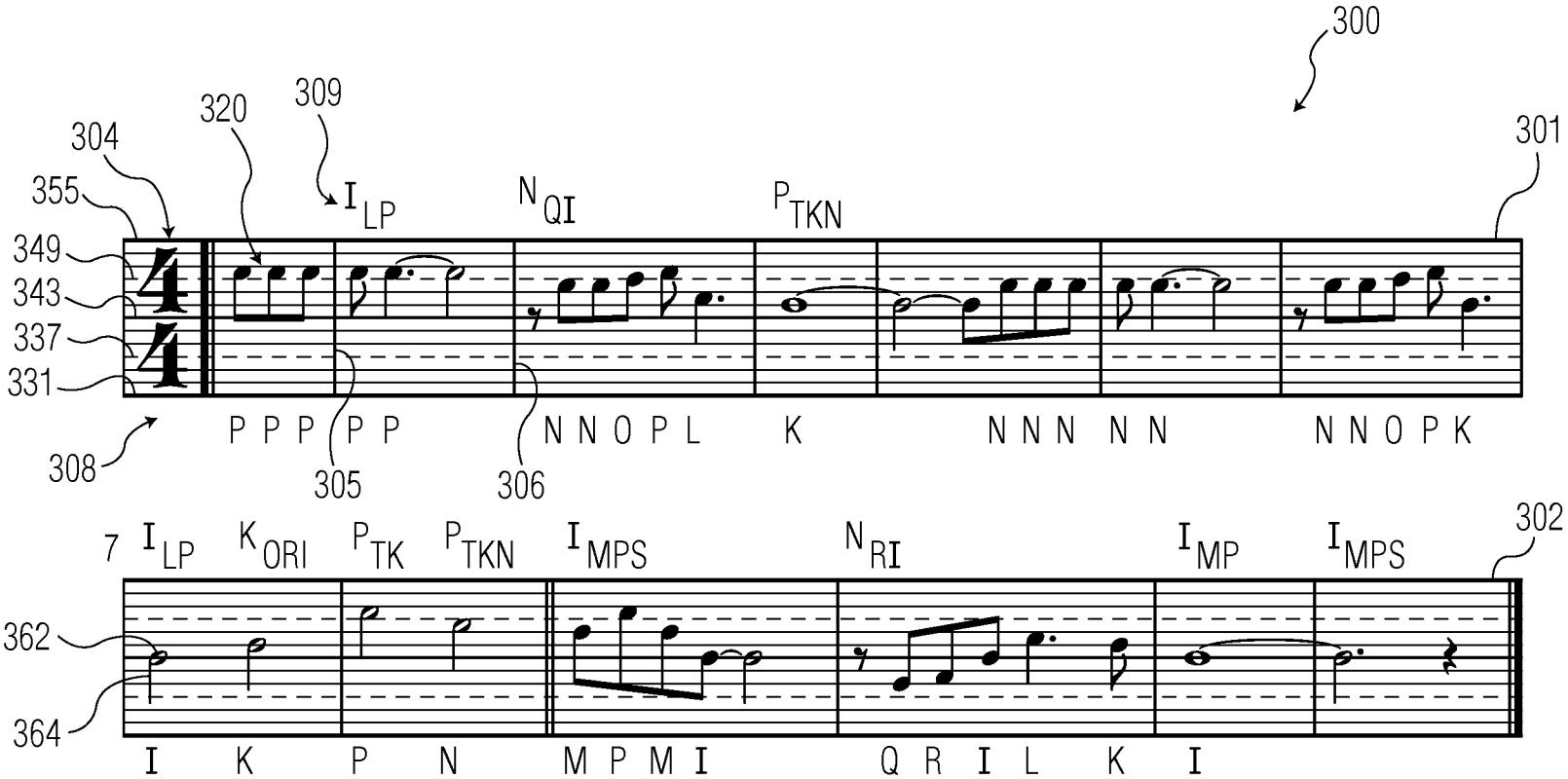
FIG. 3 is a first example of the sheet music of FIG. 1.
Figure 4:
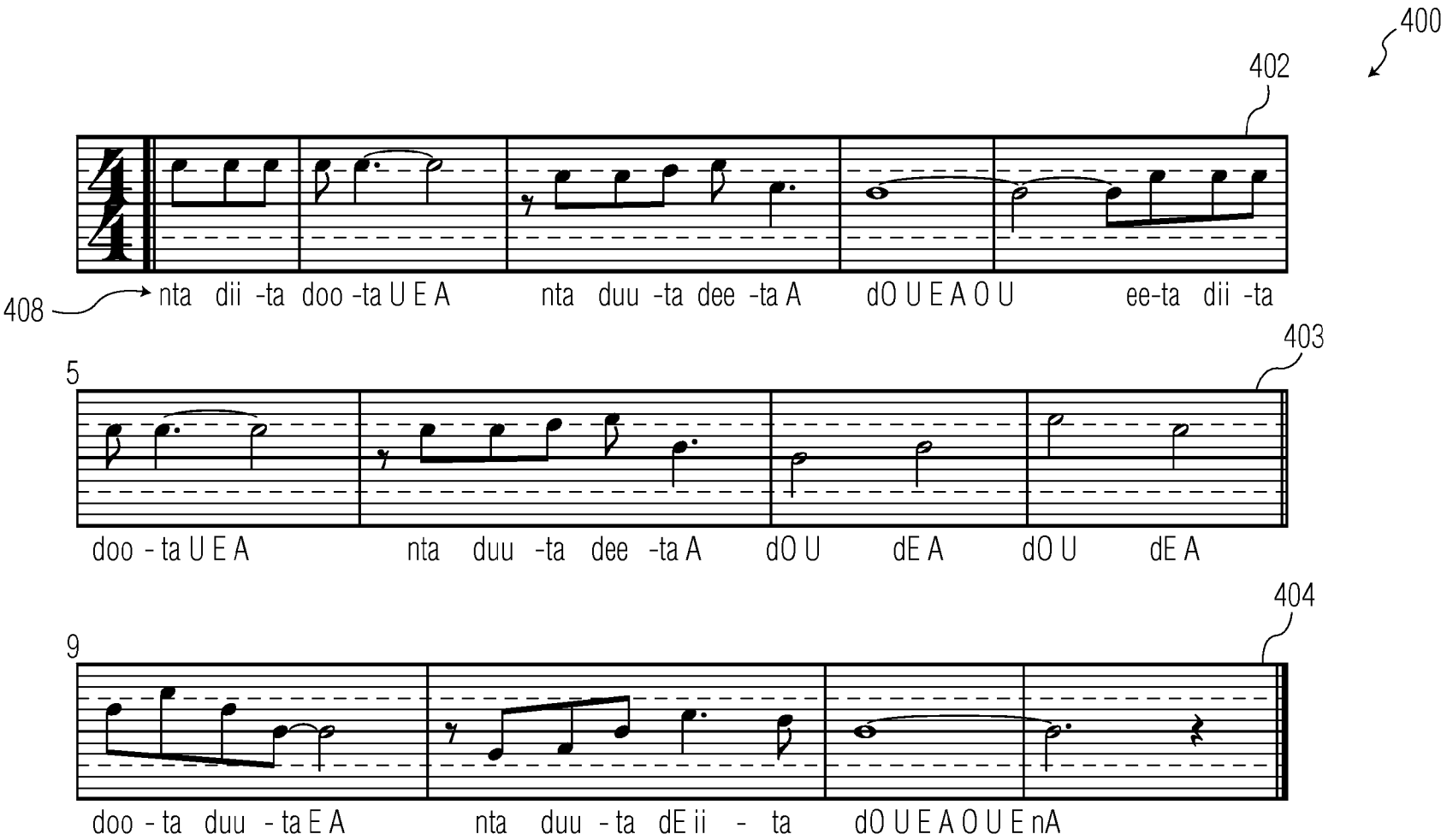
FIG. 4 is a second example of the sheet music of FIG. 1.

Alphabetic symbols I through T of a 12-tone chromatic scale are used for the apposite music of FIGS. 3 and 4. These symbols are pronounceable, single-syllable words in English.

Apposite music 320 represents an introduction and the first few measures of the famous song "St. Louis Blues" written about 1914 by W. C. Handy in a blues style. Handy's version in transposable music was written in the key of G and begins on conventional pitch D a bit more than one octave above middle C. A suitable reference pitch for sequence 320 is G above middle C so the first pitch D is transcoded to P (see Table 1).

Staff 301 (and identical staff 302) presents horizontal lines, in a vertical series to present a sequence in time from left to right of staff 301 followed by additional time from left to right of staff 302. Filled or open dots 362 for tones are engraved on either a line of staff 301 (302) or in a space between lines. For a two-octave range of a 12-tone apposite chromatic scale where the tones are named with letters I through T, staff 301 (302) presents 13 lines and 12 spaces for the engraving of notes for tones I-T (corresponding in alphabetical order to higher sound) in a first octave beginning on the lowest horizontal line 331, notes for tones I-T in a second octave immediately higher in sound from the first octave and beginning on central line 343, and a note for tone I in a third octave immediately higher in sound from the second octave and presented on the highest horizontal line 355. Notes for additional tones beyond the range of the lines and spaces of the staff are engraved below and/or above the staff in a manner analogous to conventional engraving of traditional music.

In FIG. 3, lyrics 308 identify the name of the tone for the note directly above each lyric syllable. Lyrics 308 present a symbol that in English corresponds to a one syllable word for the name of each tone (e.g., pee, en, oh, el, kay, etc.). The reference pitch (G above middle C) corresponds to the last note of staff 302, presented on central line 343 with the lyric I (a long vowel, pronounced like the word 'eye'). The octave position of a tone may be indicated by underscores or overscores. For example, in the measure third from the end of staff 302, Q and R may be presented in single underscore format to distinguish from tones represented on or above central line 343.

A staff may include line formats that simplify reading the staff by machine or human. For example, staff 301 (and identical staff 302) include a line format (e.g., thicker) that distinguishes lines 331, 343, and 355 from all other lines (e.g., not as thick). As shown in FIG. 3, tone I in one of three octaves is represented on a thicker line 331, 343, or 355. Staff 301 (and identical staff 302) also includes a line format (e.g., dashed) that distinguishes line 337 and 349 from all other lines (e.g., continuous). As shown in FIG. 3, tone O in each of two octaves is represented on dashed line 337 or 349. When the lines are numbered from lowest vertical position to highest vertical position, the 1st, 7th, and 13th line are distinguished as appositely thicker than the other lines and the 4th and 10th lines are distinguished as dashed.

The sequence of apposite chords 309 is engraved, according to various aspects of the present invention, with reference to the tones of the same 12-tone apposite chromatic scale used for the notes (e.g., also shown in lyrics 308). The root tone of the apposite chord is engraved with a subscript that identifies each tone member of the chord. Conventional criteria for membership in the chord is used. For example, chord names 309 are determined from indicia of transposable chords read by reading process 122 by operation of transcoding as discussed above. The inputs and outputs regarding the transcoding of transposable chord notation are illustrated in Table 3 for the sequence of apposite chords 309 of FIG. 3.

TABLE 3

| Chord | Root incomplete pitch | Member incomplete pitches | Root incomplete tone | Member incomplete tones |
|---|---|---|---|---|
| Gm | G | A♯, D | I | L, P |
| G | G | B, D | I | M, P |
| G7 | G | B, D, F | I | M, P, S |
| A7 | A | C♯, E, G | K | O, R, I |
| Cm | C | D♯, G | N | Q, I |
| C | C | E, G | N | R, I |
| D | D | F♯, A | P | T, K |
| D7 | D | F♯, A, C | P | T, K, N |

Apposite chord member tones may be underscored or overscored to indicate the octave of the tone as needed. For example, transposable chord C9 with reference pitch middle C would transcode to I with subscripts M, P, S, and K where K is engraved with a single overscore (one short horizontal line above the letter).

Apposite music 137 for the preparation of sheet music may include specifications for lyrics that describe the respective durations of rests and notes. For example, sheet music 400 of FIG. 4, written according to various aspects of the present invention, includes staves 402, 403, and 404 engraved with the same sequence of apposite music as in FIG. 3. Lyrics 408 are determined according to rules stated and explained in Table 4. The lyrics in FIG. 4 correspond to a conventional swing interpretation of eighth notes.

TABLE 4

| Basic Definition | Further Definition | Pronunciation | Examples |
|---|---|---|---|
| One word per beat of the measure. One syllable for each note. | Use hyphens between syllables of the word for more than one note of the beat. | Begin a syllable with the consonant d or t for each note played with an attack. | Omit the consonant when there is no attack, e.g., the note is tied or slurred from a prior note. |
| Vowels indicate the count of the beat. | Long vowels O, U, E, A correspond to whole beats 1-4 | Pronounce dO as doe; dU as dew; dE as in deed; and dA as day. | Two half notes in a measure are dOU dEA. |
| Short vowels indicate half beats and the count of the beat. | Short vowels o, u, e, i correspond to an eighth note on beats 1-4. | Pronounce do as in dot; du as in dud; de as in dead; and di as in did. | On count 1, two straight eighths are dodo. |
| The syllable ta indicates a duration less than a half beat. | Triplets on one beat are represented as tatata. | Pronounce ta as in top. | A grace note may omit the vowel e.g., t'dA |

TABLE 4-continued

| Basic Definition | Further Definition | Pronunciation | Examples |
|---|---|---|---|
| An n indicates a rest. | Full beat rests are nO, nU, nE, nA. Half beat rests are no, nu, ne, ni, or simply n. | Sound a short hum for n and a longer hum for nn, as in hen with out the h or e. | On count 2, a rest and straight eighth is ndu; or dun pronounced as in Dublin without the b, l, or i; a rest and swing eighth is nnta or doon. |
| Repeat the vowel for a dotted note or rest. | A dotted eighth note is doo, duu, dee, or dii if on the first part of beats 1-4. | Pronounce double short vowels with twice the duration and not as long vowels. | On count 1, two swing eighths are doota or dotaa. |

In an example implementation of a transcoding engine 120, according to various aspects of the present invention, input is read in Lilytext and output is produce in Lilytext. Input transposable music read by transcoding engine 120 for the music shown in FIG. 3 is described in Table 5.

TABLE 5

| Line | Transposable Music |
|---|---|
| 1 | \relative c" { \bar ".\|" |
| 2 | \numericTimeSignature \time 4/4 |
| 3 | \set Timing.measurePosition = #(ly:make-moment −3/8) |
| 4 | d8 d d \| d8^\markup { Gm } d4.~ d2 \| |

TABLE 5-continued

| Line | Transposable Music |
|---|---|
| 5 | r8^\markup { Cm } c c cis d bes4. \| |
| 6 | a1~^\markup { D7 } \| a2~ a8 c c c \| |
| 7 | c c4.~ c2 \| r8 c c cis d a4.\| |
| 8 | g2^\markup { Gm } a2^\markup { A7 } \| |
| 9 | d2^\markup { D } c2^\markup { D7 } \| \bar "\|\|" |
| 10 | b8^\markup { G7 } d b g~ g2 \| |
| 11 | r8^\markup { C } dis8 e g bes4. a8 \| |
| 12 | g1~^\markup { G } \| |
| 13 | g2.^\markup { G7 } r4 \| \bar ".\|." } |

At Table 5 line 1, an octave for pitch is specified as the C above middle C. At line 4, the first transposable note is specified. The first transposable note, specified as "d8", has the pitch D above C above middle C; and has the duration of ⅛ of the measure. At line 4 the pickup to the first measure is defined with the transposable chord Gm (a G minor chord). Lines 5 through 9 specify the introduction. Lines 10 through 13 specify the first four measures of the melody.

Continuing with this example, transcoding engine 120 reads transposable music as in Table 5 and produces output apposite music 137 as in Table 6. The apposite music is produced for engraving by an engraving engine comprising LilyPond software. Results of engraving correspond to FIG. 3.

TABLE 6

| Line | Apposite Music with Tone Lyrics and Apposite Chords |
|---|---|
| 1 | \include "../AppositeStaff.ly" \new AppositeStaff |
| 2 | { \bar ".\|" |
| 3 | \override Staff.Clef #'stencil = ##f |
| 4 | \numericTimeSignature \time 4/4 |
| 5 | \override Staff.TimeSignature.font-size = #8 |
| 6 | \set Timing.measurePosition = #(ly:make-moment −3/8) |
| 7 | cP8 cP cP \| cP8^\markup { I\normal-size-sub {LP} } cP4.~ cP2 \| |
| 8 | r8^\markup { N\normal-size-sub {QI} } cN cN cO cP cL4. \| |
| 9 | cK1~^\markup { P\normal-size-sub {TKN} } \| cK2~ cK8 cN cN cN \| cN cN4.~ cN2 \| |
| 10 | r8 cN cN cO cP cK4.\| cI2^\markup { I\normal-size-sub {LP} } |
| 11 | cK2^\markup { K \normal-size-sub {ORI} } \| |
| 12 | cP2^\markup { P\normal-size-sub {TK} } cN2^\markup { P \normal-size-sub {TKN} } |
| 13 | \| \bar "\|\|" cM8^\markup { I\normal-size-sub {MPS} } cP cM cI~ cI2 \| |
| 14 | r8^\markup { N\normal-size-sub {RI} } bQ8 bR cI cL4. cK8 \| |
| 15 | cI1~^\markup { I\normal-size-sub {MP} } \| cI2.^\markup { I\normal-size-sub {MPS} } |
| 16 | r4 \| \bar ".\|." } |
| 17 | \addlyrics { P P P P P N N O P L K N N N N N N N O P K I K P N |
| 18 | M P M I Q R I L K I } |

At line 1, a definition of a staff is specified. At line 7 the first apposite note is specified. The first apposite note, specified as cP8", has the tone P in the third octave of the staff; and has the duration of ⅛ of the measure. At line 4 the pickup to the first measure is defined with the apposite chord $I_{LP}$ (a minor chord on the reference pitch). Lines 8 through 12 specify the introduction. Lines 13 through 18 specify the first four measures of the melody. Lyrics are specified with one symbol (i.e., one syllable) per note having an attack.

Continuing with this example, transcoding engine 120 reads transposable music as in Table 5 and produces output apposite music 137 as in Table 7. The apposite music is produced for engraving by an engraving engine comprising LilyPond software. Results of engraving correspond to FIG. 4.

TABLE 7

| Line | Apposite Music with Rhythm Lyrics |
|---|---|
| 1 | \include "../AppositeStaff.ly" \new AppositeStaff { \bar ".\|" |
| 2 | \override Staff.Clef #'stencil = ##f \numericTimeSignature \time 4/4 |
| 3 | \override Staff.TimeSignature.font-size = #8 |
| 4 | \set Timing.measurePosition = #(ly:make-moment −3/8) |
| 5 | cP8 cP cP \|cP8 cP4.~ cP2 \| r8 cN cN cO cP cL4. \| cK1~ \| cK2~ cK8 cN cN cN \| |
| 6 | cN cN4.~ cN2 \| r8 cN cN cO cP cK4.\| cI2 cK2 \| cP2 cN2 \| \bar "\|\|" |
| 7 | cM8 cP cM cI~ cI2 \|r8 bQ8 bR cI cL4. cK8 \| cI1~ \| cI2. r4 \| \bar "\|." } |
| 8 | \addlyrics { nta dii -- ta \| doo -- ta_U_E_A \| nta duu -- ta dee -- ta_A \| |
| 9 | dO_U_E_A_O_U ee-ta dii -- ta \| doo -- ta_U_E_A \| nta duu -- ta dee -- ta_A \| |
| 10 | dO_U dE_A \| dO_U dE_A \| doo -- ta duu -- ta_E_A \| nta duu -- ta dE_ii -- ta \| |
| 11 | dO_U_E_A_O_U_E_nA \| } |

Lines 5 through 7 correspond to the same apposite music as in Table 6. Lines 8 through 11 specify lyrics. Short vowels are in lower case. Long vowels are in upper case. One word is aligned under the notes for each beat, with hyphenation to align one syllable under each note having an attack. When a note extends over several beats, the words for these beats are kept together. The Lilytext \addlyrics command does not allow for a lyric aligned under a rest. Consequently, the lyric for the rest is joined to the preceding syllable (e.g., _nA in line 11 last syllable) or to the following syllable (e.g., nta in line 8 second full measure).

To complete this example implementation, information for the engraving of staff 301, 302, 402, 403, 404 is described in Tables 8 and 9. The instructions in Tables 8 and 9 are to be combined into one file.

TABLE 8

| Line | Definition of a Staff |
|---|---|
| 1 | % This is AppositeStaff1.ly Lilypond Engraver Input File version 2.18.1 |
| 2 | #(ly:make-scale '#( 0 1/2 1 3/2 2 5/2 3 7/2 4 9/2 5 11/2 6 13/2 7 15/2 8 17/2 9 19/2 10 |
| 3 | 21/2 11 23/2 12 25/2 26 )) |
| 4 | pitchnames = #`( |
| 5 | (aT . ,(ly:make-pitch −1 0 NATURAL)) (bI . ,(ly:make-pitch −1 1 NATURAL)) |
| 6 | (bJ . ,(ly:make-pitch −1 2 NATURAL)) (bK . ,(ly:make-pitch −1 3 NATURAL)) |
| 7 | (bL . ,(ly:make-pitch −1 4 NATURAL)) (bM . ,(ly:make-pitch −1 5 NATURAL)) |
| 8 | (bN . ,(ly:make-pitch −1 6 NATURAL)) (bO . ,(ly:make-pitch −1 7 NATURAL)) |
| 9 | (bP . ,(ly:make-pitch −1 8 NATURAL)) (bQ . ,(ly:make-pitch −1 9 NATURAL)) |
| 10 | (bR . ,(ly:make-pitch −1 10 NATURAL)) (bS . ,(ly:make-pitch −1 11 NATURAL)) |
| 11 | (bT . ,(ly:make-pitch −1 12 NATURAL)) (cI . ,(ly:make-pitch −1 13 NATURAL)) |
| 12 | (cJ . ,(ly:make-pitch −1 14 NATURAL)) (cK . ,(ly:make-pitch −1 15 NATURAL)) |
| 13 | (cL . ,(ly:make-pitch −1 16 NATURAL)) (cM . ,(ly:make-pitch −1 17 NATURAL)) |
| 14 | (cN . ,(ly:make-pitch −1 18 NATURAL)) (cO . ,(ly:make-pitch −1 19 NATURAL)) |
| 15 | (cP . ,(ly:make-pitch −1 20 NATURAL)) (cQ . ,(ly:make-pitch −1 21 NATURAL)) |
| 16 | (cR . ,(ly:make-pitch −1 22 NATURAL)) (cS . ,(ly:make-pitch −1 23 NATURAL)) |
| 17 | (cT . ,(ly:make-pitch −1 24 NATURAL)) (dI . ,(ly:make-pitch −1 25 NATURAL)) |
| 18 | (dJ . ,(ly:make-pitch −1 26 NATURAL)) ) |
| 19 | #(ly:parser-set-note-names parser pitchnames) |

At line 2 of Table 8, 27 half-step tones from low to high (vertically) are defined to include the space under the staff, two octaves, the top line of the staff, and the space above the staff. At lines 5 through 18, unique names for these tones are defined with a first lower case letter to indicate a vertical region of the staff and an upper case letter to indicate the tone. Lilytext uses the term 'pitch' instead of 'tone' because Lilytext was designed for the engraving of transposable music.

TABLE 9

| Line | Definition of a Staff (Continued) |
|---|---|
| 1 | dashedStaffSymbolLines = |
| 2 | #(define-music-function (parser location dash-space bool-list) |
| 3 | ((number-pair? '(0.5 . 0.5)) list?) |
| 4 | #{ \override Staff.StaffSymbol #'after-line-breaking = #(lambda (grob) |
| 5 | (let* ((staff-stencil (ly:grob-property grob 'stencil)) |
| 6 | (staff-line-positions (ly:grob-property grob 'line-positions)) |
| 7 | (staff-width (interval-length (ly:stencil-extent staff-stencil X))) |
| 8 | (staff-space (ly:staff-symbol-staff-space grob)) |
| 9 | (staff-line-thickness (ly:staff-symbol-line-thickness grob)) |
| 10 | (dash-width (car dash-space)) (space-width (cdr dash-space)) |
| 11 | (sample-path `((moveto 0 0) (lineto ,dash-width 0) )) |
| 12 | (dash-stencil (grob-interpret-markup grob (markup |
| 13 | #:path staff-line-thickness sample-path))) |
| 14 | (dash-space-width (+ dash-width space-width)) |
| 15 | (count-dashes (inexact->exact (round (/ staff-width (- dash-space-width |
| 16 | staff-line-thickness))))) |
| 17 | (dashed-stil (ly:stencil-aligned-to (apply ly:stencil-add (map (lambda (x) |
| 18 | (ly:stencil-translate-axis dash-stencil (* (- dash-space-width staff-line-thickness) x) |
| 19 | X)) (iota count-dashes))) Y CENTER)) |
| 20 | (stil-x-length (interval-length (ly:stencil-extent dashed-stil X))) |
| 21 | (line-stil (make-line-stencil staff-line-thickness 0 0 staff-width 0)) |
| 22 | (corr-factor (/ staff-width (- stil-x-length staff-line-thickness))) |
| 23 | (new-stil (apply ly:stencil-add (map (lambda (x y) (ly:stencil-translate |
| 24 | (if (eq? y #f) line-stil (ly:stencil-scale dashed-stil corr-factor 1)) |
| 25 | (cons (/ staff-line-thickness 2) (* (/ x 2) staff-space)))) |
| 26 | staff-line-positions bool-list)))) |
| 27 | (if (= (length bool-list)(length staff-line-positions)) (ly:grob-set-property! grob 'stencil |
| 28 | new-stil) (ly:warning "length of bool-list doesn't fit the line-positions - ignoring")))) |
| 29 | #}) |
| 30 | \paper { top-margin = 0.75\in markup-system-spacing = 24 |
| 31 | system-system-spacing = #'((minimum-distance . 12) (padding . 8))} |
| 32 | \layout { \context { \Staff \name AppositeStaff \alias Staff |
| 33 | \override Score.NonMusicalPaperColumn.padding = #10 \override StaffSymbol |
| 34 | #'line-positions = #'( −12.2 −12 −11.8 −10 −8 −6 −4 −2 −.02 0 0.2 2 4 6 8 10 11.8 12 12.2) |
| 35 | \dashedStaffSymbolLines #'(1 . 1) |
| 36 | #'( #f #f #f #f #f #f #t #f #f #f #f #f #f #f #f #t #f #f #f #f #f #f) } |
| 37 | \context { \Score \accepts AppositeStaff }} |

In Table 9, a dashed line is defined in lines 1 through 29. A thirteen line staff is defined in lines 34 and 35 with two additional lines specified for each bold line (bottom, middle, and top). The position of two dashed lines in the 13 line staff is defined in line 36, again counting three lines for each bold line.

As a first example implementation, according to various aspects of the present invention, a method is performed by apparatus comprising a processor. The method transcodes music notation to control an engraving engine. The method includes, in any practical order, (a) reading indicia of a plurality of pitches; (b) determining a range of pitch in accordance with a lowest respective pitch of the plurality and a highest respective pitch of the plurality; (c) determining a key; (d) determining a reference pitch in accordance with the key and the range of pitch; (e) determining indicia of a plurality of tones, each respective tone being in accordance with a respective pitch of the plurality of pitches and in accordance with the reference pitch; (f) determining a staff in accordance with the range of pitch; and (g) outputting, for use by a music engraving engine, indicia of the staff, and indicia of the plurality of tones. Outputting controls (1) engraving of the staff to provide a plurality of horizontal lines defining a plurality of horizontal spaces between the lines, each line comprising a first appearance or a second appearance; (2) engraving successive tones of the plurality of tones so that a quantity of lines and spaces between successive tones indicates a quantity of half steps of difference between successive tones; (3) engraving of each tone that does not correspond to the reference pitch onto a space or a line comprising the first appearance; and (4) engraving of each tone that does correspond to the reference pitch onto a line comprising the second appearance.

As a second example implementation, according to various aspects of the present invention, a method is performed by apparatus comprising a processor. The method transcodes music notation to control an engraving engine. The method includes, in any practical order, (a) reading indicia of a plurality of pitches; (b) determining a range of pitch in accordance with a lowest respective pitch of the plurality and a highest respective pitch of the plurality; (c) determining a key by at least one of reading indicia of a key signature, reading indicia of a chord, reading input from a user, and selecting a pitch of a note of the plurality of notes; (d) determining a reference pitch in accordance with the key and the range of pitch; (e) determining indicia of a plurality of tones, each respective tone being in accordance with a respective pitch of the plurality of pitches and in accordance with the reference pitch; (f) determining a staff in accordance with the range of pitch; and (g) outputting, for use by a music engraving engine, indicia of the staff, and indicia of the plurality of tones. Outputting controls (1) engraving of the staff to provide a plurality of horizontal lines defining a plurality of horizontal spaces between the lines, each line comprising a first appearance or a second appearance; (2) engraving successive tones of the plurality of tones so that a quantity of lines and spaces between successive tones indicates a quantity of half steps of difference between successive tones; (3) engraving of each tone that does not correspond to the reference pitch onto a space or a line comprising the first appearance; and (4) engraving of each tone that does correspond to the reference pitch onto a line comprising the second appearance.

In variations of the method of the first and second example, the key is an incomplete pitch and determining the reference pitch includes, in any practical order: (a) determining a center pitch of the range of pitch; (b) determining an octave of which the center pitch is a member; and (c) determining the reference pitch as a complete pitch comprising the octave and the key.

In further variations of any of the above examples, determining a respective tone in accordance with a respective pitch includes determining a respective quantity of half steps; and determining each quantity of half steps comprises subtracting the reference pitch from the respective pitch.

Any of the examples discussed above may include outputting that further controls: (1) engraving of each line of the plurality of lines so that each line comprises a first appearance, a second appearance, or a third appearance; (2) engraving of each tone that is six half steps above the reference pitch onto a line comprising the third appearance.

Any of the example methods discussed above may further include (a) reading indicia of a plurality of measures and indicia of a plurality of chords, each chord associated with a respective measure; and (b) determining indicia of a plurality of sets of tones, one set associated to each chord of the plurality of chords; wherein (1) for each particular set determining, in accordance with the indicia of the associated chord, a multiplicity of pitches for the chord associated to the set so that for each tone of the particular set determining a respective tone of the set in accordance with a pitch of the multiplicity of pitches and with the reference pitch; and (2) outputting further includes outputting indicia of the plurality of measures and indicia of the plurality of sets of tones, wherein each set associated with a particular measure of the plurality is a substitute for the chord associated with the particular measure of the plurality.

Any of the example methods based on the method of the prior paragraph may be practiced with indicia of each particular set of tones including a respective symbol for each tone of the set of tones; and every symbol being a member of one group consisting of twelve symbols.

The foregoing description discusses preferred embodiments of the present invention, which may be changed or modified without departing from the scope of the present invention as defined in the claims. The examples listed in parentheses may be alternative or combined in any manner. The invention includes any practical combination of the structures and methods disclosed. As used in the specification and claims, the words 'having' and 'including' in all grammatical variants are open-ended and synonymous with 'comprising' and its grammatical variants. While for the sake of clarity of description several specific embodiments of the invention have been described, the scope of the invention is intended to be measured by the claims as set forth below.

What is claimed is:

1. A method performed by apparatus comprising a processor, the method for transcoding music notation to control an engraving engine, the method comprising:

reading indicia of a plurality of pitches;

determining a range of pitch in accordance with a lowest respective pitch of the plurality and a highest respective pitch of the plurality;

determining a key, wherein the key is an incomplete pitch;

determining a reference pitch in accordance with the key and the range of pitch, wherein determining comprises determining a center pitch of the range of pitch, determining an octave of which the center pitch is a member, and determining the reference pitch as a complete pitch comprising the octave and the key;

determining indicia of a plurality of tones, each respective tone being in accordance with a respective pitch of the plurality of pitches and in accordance with the reference pitch;

determining a staff in accordance with the range of pitch; and outputting, for use by a music engraving engine, indicia of the staff, and indicia of the plurality of tones to control engraving of the staff to provide a plurality of horizontal lines defining a plurality of horizontal spaces between the lines, each line comprising a first appearance or a second appearance;

engraving successive tones of the plurality of tones so that a quantity of lines and spaces between successive tones indicates a quantity of half steps of difference between successive tones;

engraving of each tone that does not correspond to the reference pitch onto a space or a line comprising the first appearance; and engraving of each tone that does correspond to the reference pitch onto a line comprising the second appearance.

2. The method of claim 1 wherein determining the key comprises at least one of reading indicia of a key signature, reading indicia of a chord, reading input from a user, and selecting a pitch of a note of the plurality of notes.

3. The method of claim 1 wherein:

the determining a respective tone in accordance with a respective pitch comprises determining a respective quantity of half steps; and determining each quantity of half steps comprises subtracting the reference pitch from the respective pitch.

4. A method performed by apparatus comprising a processor, the method for transcoding music notation to control an engraving engine, the method comprising:

reading indicia of a plurality of pitches;

determining a range of pitch in accordance with a lowest respective pitch of the plurality and a highest respective pitch of the plurality;

determining a key;

determining a reference pitch in accordance with the key and the range of pitch;

determining indicia of a plurality of tones, each respective tone being in accordance with a respective pitch of the plurality of pitches and in accordance with the reference pitch;

determining a staff in accordance with the range of pitch; and outputting, for use by a music engraving engine, indicia of the staff, and indicia of the plurality of tones to control engraving of the staff to provide a plurality of horizontal lines defining a plurality of horizontal spaces between the lines, each line comprising a first appearance or a second appearance;

engraving successive tones of the plurality of tones so that a quantity of lines and spaces between successive tones indicates a quantity of half steps of difference between successive tones;

engraving of each tone that does not correspond to the reference pitch onto a space or a line comprising the first appearance; and engraving of each tone that does correspond to the reference pitch onto a line comprising the second appearance;

engraving of each line of the plurality of lines so that each line comprises a first appearance, a second appearance, or a third appearance; and engraving of each tone that is six half steps above the reference pitch onto a line comprising the third appearance.

5. A method performed by apparatus comprising a processor, the method for transcoding music notation to control an engraving engine, the method comprising:

reading indicia of a plurality of pitches;

determining a range of pitch in accordance with a lowest respective pitch of the plurality and a highest respective pitch of the plurality;

determining a key;

determining a reference pitch in accordance with the key and the range of pitch;

determining indicia of a plurality of tones, each respective tone being in accordance with a respective pitch of the plurality of pitches and in accordance with the reference pitch;

determining a staff in accordance with the range of pitch; and outputting, for use by a music engraving engine, indicia of the staff, and indicia of the plurality of tones to control engraving of the staff to provide a plurality of horizontal lines defining a plurality of horizontal spaces between the lines, each line comprising a first appearance or a second appearance;

engraving successive tones of the plurality of tones so that a quantity of lines and spaces between successive tones indicates a quantity of half steps of difference between successive tones;

engraving of each tone that does not correspond to the reference pitch onto a space or a line comprising the first appearance; and engraving of each tone that does correspond to the reference pitch onto a line comprising the second appearance; wherein reading further comprises reading indicia of a plurality of measures and indicia of a plurality of chords, each chord associated with a respective measure;

the method further comprises determining indicia of a plurality of sets of tones, one set associated to each chord of the plurality of chords, wherein for each particular set determining, in accordance with the indicia of the associated chord, a multiplicity of pitches for the chord associated to the set; and for each tone of the particular set determining a respective tone of the set in accordance with a pitch of the multiplicity of pitches and with the reference pitch; and outputting further comprises outputting indicia of the plurality of measures and indicia of the plurality of sets of tones, wherein each set associated with a particular measure of the plurality is a substitute for the chord associated with the particular measure of the plurality.

6. The method of claim 5 wherein:

indicia of each particular set of tones comprises a respective symbol for each tone of the set of tones; and every symbol is a member of one group consisting of twelve symbols.

* * * * *